US011135631B2

(12) United States Patent
Weinzierl et al.

(10) Patent No.: US 11,135,631 B2
(45) Date of Patent: Oct. 5, 2021

(54) CONTROL OF THE WATER ECONOMY OF A COOLING PATH

(71) Applicant: Primetals Technologies Germany GmbH, Erlangen (DE)

(72) Inventors: Klaus Weinzierl, Nuremberg (DE); Manfred Eder, Thalheim bei Wels (AT); Jurij Razinkov, Leonding (AT); Christian Schlapak, Leonding (AT)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 0 days.

(21) Appl. No.: 16/771,500

(22) PCT Filed: Nov. 16, 2018

(86) PCT No.: PCT/EP2018/081500
§ 371 (c)(1),
(2) Date: Jun. 10, 2020

(87) PCT Pub. No.: WO2019/115145
PCT Pub. Date: Jun. 20, 2019

(65) Prior Publication Data

US 2020/0376527 A1 Dec. 3, 2020

(30) Foreign Application Priority Data

Dec. 11, 2017 (EP) ..... 17206426

(51) Int. Cl.
*B21B 37/76* (2006.01)
*C21D 1/00* (2006.01)
(Continued)

(52) U.S. Cl.
CPC ..... *B21B 37/76* (2013.01); *B21B 45/0218* (2013.01); *C21D 1/00* (2013.01);
(Continued)

(58) Field of Classification Search
CPC ..... B21B 37/76; B21B 45/02; B21B 45/0218; B21B 45/0215; B21B 45/0244;
(Continued)

(56) References Cited

U.S. PATENT DOCUMENTS

2006/0225474 A1* 10/2006 Reinschke ..... B21B 37/74 72/8.5
2015/0328670 A1* 11/2015 Aiken ..... B05B 12/12 72/12.2

FOREIGN PATENT DOCUMENTS

CN 204685675 U 10/2015
CN 105163876 A 12/2015
(Continued)

OTHER PUBLICATIONS

International Search Report and Written Opinion received in PCT/EP2018/081500 dated Dec. 14, 2018, pp. 13.
(Continued)

*Primary Examiner* — Rebecca Janssen
(74) *Attorney, Agent, or Firm* — Liang & Hennessey LLP; Brian Hennessey

(57) ABSTRACT

In a cooling path, hot rolled material composed of metal is cooled. The cooling path has a pump which extracts coolant from a coolant reservoir and feeds said coolant via a line system to a number of coolant outlets which are controlled by means of valves positioned upstream of the coolant outlets. A control device of the cooling path determines activation states (Ci) for the valves for a respective point in time taking into consideration coolant flows (Wi) which are intended to be discharged via the coolant outlets at the respective point in time, in conjunction with a working pressure (pA) of the coolant prevailing at the inlet side of the valve. By adding the coolant flows (Wi), said control device determines a total coolant flow (WG).

14 Claims, 8 Drawing Sheets

(51) Int. Cl.

| | |
|---|---|
| ***C21D 1/60*** | (2006.01) |
| ***C21D 9/52*** | (2006.01) |
| ***C21D 11/00*** | (2006.01) |
| ***B21B 45/02*** | (2006.01) |
| ***C21D 1/667*** | (2006.01) |
| ***C21D 9/573*** | (2006.01) |

(52) U.S. Cl.
CPC ..... *C21D 1/60* (2013.01); *C21D 1/667* (2013.01); *C21D 9/52* (2013.01); *C21D 9/573* (2013.01); *C21D 11/00* (2013.01)

(58) Field of Classification Search
CPC .. B21B 37/74; C21D 1/00; C21D 1/60; C21D 1/667; C21D 9/52; C21D 9/573; C21D 11/00
See application file for complete search history.

(56) References Cited

FOREIGN PATENT DOCUMENTS

| | | | | |
|---|---|---|---|---|
| EP | 2817425 | B1 * | 5/2016 | ..... B21B 37/76 |
| JP | S5524933 | A | 2/1980 | |
| JP | H04167916 | A | 6/1992 | |
| WO | 2013143925 | A1 | 10/2013 | |
| WO | 2014124868 | A1 | 8/2014 | |

OTHER PUBLICATIONS

European Search Report received in 17206426.3 dated Jun. 7, 2018, pp. 6.
Chinese Office Action received in 201880079935.X dated May 6, 2021, pp. 1-15.

* cited by examiner

CONTROL OF THE WATER ECONOMY OF A COOLING PATH

CROSS REFERENCE TO RELATED APPLICATIONS

The present application is a national phase application of PCT Application No. PCT/EP2018/081500, filed Nov. 16, 2018, entitled "IMPROVED CONTROL OF THE WATER ECONOMY OF A COOLING PATH", which claims the benefit of European Patent Application No. 17206426.3, filed Dec. 11, 2017, each of which is incorporated by reference in its entirety.

BACKGROUND OF THE INVENTION

1. Field of the Invention

The invention relates to a method of operation for a cooling path for cooling hot rolled material composed of metal.

2. Description of the Related Art

The present invention is based on a method of operation for a cooling path for cooling hot rolled material composed of metal, wherein the cooling path has a pump, which extracts coolant from a coolant reservoir and feeds it via a line system to a number of coolant outlets, which are controlled via valves positioned upstream of the coolant outlets, wherein a control device of the cooling path, cyclically for a respective point in time taking into consideration coolant flows, which are intended to be discharged via the coolant outlets at the respective point in time, in conjunction with a working pressure of the coolant prevailing at the inlet side of the valves, determines activation states for the valves, determines a total coolant flow by summing the coolant flows, taking into consideration the total coolant flow and the working pressure of the coolant, determines a pump pressure that is intended to prevail at the outlet side of the pump, so that the working pressure is achieved at the inlet side of the valves, taking into consideration the total coolant flow of the pump pressure and a suction pressure prevailing at the inlet side of the pump, determines an activation state for the pump and activates the valves and the pump according to the activation states determined.

The present invention is furthermore based on a computer program, which comprises machine code that is able to be processed by a control device for a cooling path, wherein the processing of the machine code by the control device causes the control device to operate the cooling path in accordance with such a method of operation.

The present invention is furthermore based on a control device for a cooling path, wherein the control device is programmed with a computer program of this type, so that the control device operates the cooling path in accordance with a method of operation of this type.

The present invention is furthermore based on a cooling path for cooling hot rolled material composed of metal, wherein the cooling path has a pump, which extracts coolant from a coolant reservoir and feeds said coolant via a line system to a number of coolant outlets, which are controlled via valves positioned upstream of the coolant outlets, wherein the cooling path has a control device of this type, which operates the cooling path in accordance with a method of operation of this type.

The subject matter described above is known from WO 2013/143 925 A1 for example. Similar disclosure content can be found in WO 2014/124 867 A1.

Rolled metal—in particular steel—is cooled down in cooling paths after rolling. Examples of such cooling paths are the cooling path positioned downstream from a hot rolling mill with or without intensive cooling and what is known as the quencher of a heavy plate mill. An exact control of temperature is usual in particular in a cooling path positioned downstream of the rolling mill. However the defined and exact provision of desired amount of coolant is also of great importance in the event of the path being positioned within or upstream of a rolling mill—for example between a blooming train and a finishing train. In particular with cooling between a blooming train and a finishing train, because of the need for a large amount of coolant, especially high demands are made on the dynamics of the management of the coolant.

As a rule the coolant is water or consists at least essentially of water.

The amounts of water to be provided are significant. In some cases up to 20,000 $m^3/h$ must be applied to a stretch of just a few meters (for example 10 m to 20 m) to the hot rolled material. For precise control of the cooling it is not only necessary to activate the valves of the cooling path correctly and with precise timing. In addition it is also necessary to make available the corresponding amounts of water at the inlet side of the valves and also to take them back again. The control times required for this often lie in a range of around 1 second, in some cases even below 1 second.

In some cases it is possible to guarantee the required dynamic of water management on the basis of a corresponding mechanical structural design of the cooling path. For example a water tank can be set up in the immediate vicinity of the coolant outlets as a coolant reservoir and to supply the coolant outlets directly or via booster pumps with water from the water tank. In this case the line system between the coolant reservoir and the coolant outlets can be designed sufficiently short. This makes the required acceleration of the amount of water possible without adversely affecting the accuracy of the cooling to any appreciable extent.

In other cases however it is not possible to place a water tank sufficiently close to the coolant outlets. Sometimes the space to set up a water tank is only available outside the production shop. The line system for supplying the coolant outlets has a significantly greater length in this case, for example around 100 m. It is even possible that no water tank can be set up. In this case the line system that delivers the coolant to the coolant outlets will have a length of several hundred meters. When it is not possible to place a water tank sufficiently close to the coolant, when there is a change to the amount of coolant required, larger amounts of water—often several hundred tons—have to be accelerated first. This acceleration leads in the prior art to a delayed provision of the amounts of coolant conveyed.

To solve this problem various solutions are known in the prior art.

Thus for example it is known from WO 2014/032 838 A1 that in addition to usable coolant outlets, via which the coolant is applied to the hot rolled material, bypass coolant outlets are provided. The coolant can be discharged in this case via the bypass coolant outlets without being applied to the hot rolled material. When the hot rolled material moves into a cooling area in which the coolant is to be applied to the hot rolled material, the valves positioned upstream of the bypass coolant outlets are moved back or closed while at the same time the valves positioned upstream of the usable coolant outlets are opened. In this way the coolant that is moved through the line system only has to be accelerated to a slight extent or even not at all. The disadvantage of this procedure however is that then large amounts of coolant are pumped through the line system even if no hot rolled material is to be cooled. The energy consumption for the pump and the consumption of coolant are correspondingly high.

A further known solution consists of providing a riser pipe with an overflow in the vicinity of the cooling area. A riser pipe needs less space than a water tank. It can however only store coolant for it to a limited extent. In this case therefore the maximum amount of coolant to be expected is conveyed continuously to the cooling area. It is precisely this that represents a disadvantage, since the maximum amount of coolant needed must always be provided, while in a solution with a water tank only the average amount of water needed must be delivered. Through the height of the riser pipe an almost constant counter pressure is generated, which is independent of the actual requirement for coolant. Here too the consumption of coolant and energy is correspondingly high, since an unnecessarily large amount of coolant is always provided. Furthermore the pressure cannot be adjusted. It always corresponds to the pressure that is produced by the height of the column of coolant in the riser pipe up to the overflow.

The procedures known from WO 2013/143 925 A1 already represent a significant advance compared to these procedures. But these solutions too are still capable of improvement.

SUMMARY OF THE INVENTION

The object of the present invention consists of creating possibilities by means of which, even without the possibility of greater or less storage for coolant between the pump and the coolant outlets, the amount of coolant needed can be provided at all times in an efficient way with high precision.

In accordance with the invention a method of operation of the type stated at the outset is designed so that the control device of the cooling path takes into consideration cyclically for the respective point in time in the determination of the pump pressure that is intended to prevail at the outlet side of the pump not only the total coolant flow and the working pressure of the coolant, but in addition also takes into consideration a change in the total coolant flow. Thereby the result for the pump pressure takes into consideration the extent to which the amount of coolant present in the line system must be accelerated or delayed. Through this the respective desired total coolant flow is achieved in a significantly more dynamic way than it is in the prior art.

In a preferred embodiment the control device takes into consideration in the determination of the pump pressure a line resistance of the line system to be overcome by the total coolant flow. This produces an even greater accuracy in the determination of the pump pressure and thus in the determination of the activation state of the pump.

In an especially preferred embodiment of the present invention, in addition to the coolant flows, which are intended to be discharged at the respective point in time via the coolant outlets, predicted coolant flows for a prediction horizon, which are intended to be discharged for a number of future points in time via the coolant outlets are known to the control device. In this case it is possible for the control device to take into consideration the predicted coolant flows of at least one of the future points in time in the determination of the activation state of the pump.

In particular it is possible for the control device to determine for at least one future point in time the associated total coolant flow and to take it into consideration in the determination of the change to the total coolant flow. In the simplest case for example the deviation compared to the total coolant flow for the respective point in time can be determined.

It leads to even better results if the control device, in the determination of the change to the total coolant flow, in addition to the predicted coolant flows of the at least one future point in time, also continues to take into consideration the total coolant flow of at least one previous point in time. In this case the respective point in time preferably lies in the middle between the at least one future point in time and the at least one previous point in time.

In an especially preferred embodiment the coolant outlets comprise usable coolant outlets and bypass coolant outlets. In this case the hot rolled material is cooled exclusively by means of the coolant flows discharged via the usable coolant outlets. The bypass coolant outlets serve as an option for influencing the total coolant flow without changing the coolant flows applied to the hot rolled material. In the case of this embodiment the control device determines on the basis of the coolant flows to be discharged for the respective point in time and/or the future points in time via the usable coolant outlets, the coolant flows to be discharged for the respective point in time and/or the future points in time via the bypass coolant outlets in such a way that each valid total coolant flow that was taken into consideration for an earlier point in time lying before the respective point in time as part of the determination of the change in the total coolant flow for the earlier point in time is retained.

What can be achieved by this is that the timing curve of the activation state of the pump has a relatively low dynamic. Thus a sufficiently "smooth" activation of the pump can be achieved. This increases the service life of the pump and simplifies its activation. Naturally an embodiment without bypass coolant outlets can also be realized, in which usable coolant outlets are thus exclusively present. In this case however on the one hand the pump must be activated with a relatively high dynamic. Moreover in cases in which, even with an activation of the pump with a high dynamic, a change cannot be made sufficiently quickly, a temporary deviation of the total coolant flow actually conveyed by the pump from a desired total coolant flow must be taken into account.

As an alternative or in addition to taking the predicted coolant flows of the at least one future point in time into consideration in the determination of the change in the total coolant flow, it is possible on the basis of the prediction for the control device—where necessary—to undertake a predicted adaptation of the activation state of the pump. In particular it is possible for the control device in the determination of the activation state of the pump—i.e. the determination of the activation state with which the pump is to be activated at the respective point in time, to determine on the basis of the respective predicted coolant flows a respective predicted total coolant flow for the future points in time, to determine changes in the total coolant flows determined for the future points in time and to retain or to predictively adapt the respective total coolant flows as a function of keeping to or exceeding a predetermined maximum change for the respective time and/or future points in time within the prediction horizon, so that where possible both the change in the total coolant flow for the respective point in time and also the changes in the determined total coolant flows for the future points in time keep to the maximum change.

This procedure corresponds to the usual procedure in a model predictive regulation.

If a knowledge or prediction of future total cooling flows is not possible, it is still possible to homogenize the activation of the pump. In this case the coolant outlets—as before—comprise usable coolant outlets and bypass coolant outlets. The functionality of the corresponding coolant outlets is likewise as before. In this case the control device determines the coolant flows intended to be discharged via the bypass coolant outlets in such a way that coolant flows to be discharged via the bypass coolant outlets lie close to a required bypass coolant flow and a change in the total coolant flow to be discharged overall via the usable coolant outlets and the bypass coolant outlets is as small as possible.

In individual cases the valves can be switching valves, which can only assume two switching states, namely fully open and fully closed. Preferably the valves are stepless however or able to be activated in a number of steps. Thus at least one intermediate setting of the respective valve exists between "fully open" and "fully closed".

Preferably the control device determines the working pressure in such a way that the activation states of the valves keep to minimum distances from a minimum activation and a maximum activation and the activation state of the pump is kept constant where possible. This means that the pump has to be activated with lower dynamic.

Preferably the control device additionally also takes into consideration, as part of the determination of the pump pressure, a difference in height to be overcome. The difference in height represents a constant offset for the pump pressure.

Preferably the control device additionally determines a control signal for a bypass valve connected in parallel to the pump and activates the bypass valve according to the control signal determined. This enables operating states of the pump to be achieved that would not be possible or not be permitted without a bypass valve. The coolant flow fed back via the bypass valve can be fed where necessary to the coolant reservoir or to a connecting line between the coolant reservoir and the pump.

The object is furthermore achieved by a computer program. In accordance with the invention the processing of the computer program by the control device causes the control device to operate the cooling path in accordance with an inventive method of operation.

The object is furthermore achieved by a control device for a cooling path. In accordance with the invention the control device is programmed with an inventive computer program, so that the control device operates the cooling path in accordance with an inventive method of operation.

The object is furthermore achieved by a cooling path for cooling hot rolled material composed of metal. In accordance with the invention the cooling path has an inventive control device, which operates the cooling path in accordance with an inventive method of operation. A cooling area of the cooling path, within which the coolant is applied to the hot rolled material, can in particular be positioned within a rolling mill and/or upstream of a rolling mill and/or downstream of the rolling mill. The term "and/or" is to be understood here in the sense of the cooling area being able to be positioned completely within the rolling mill, being able to be positioned completely downstream of the rolling mill or being able to be positioned partly within the rolling mill and partly downstream of the rolling mill. Similar definitions apply for an arrangement upstream of the rolling mill.

BRIEF DESCRIPTION OF THE DRAWINGS

The characteristics, features and advantages described above as well as the manner in which these are achieved will be explained more clearly and in a manner that is easier to understand in conjunction with the description given below of the exemplary embodiments, which are explained in greater detail in conjunction with the drawings. In the drawings, in schematic diagrams.

DETAILED DESCRIPTION

Figure 1:
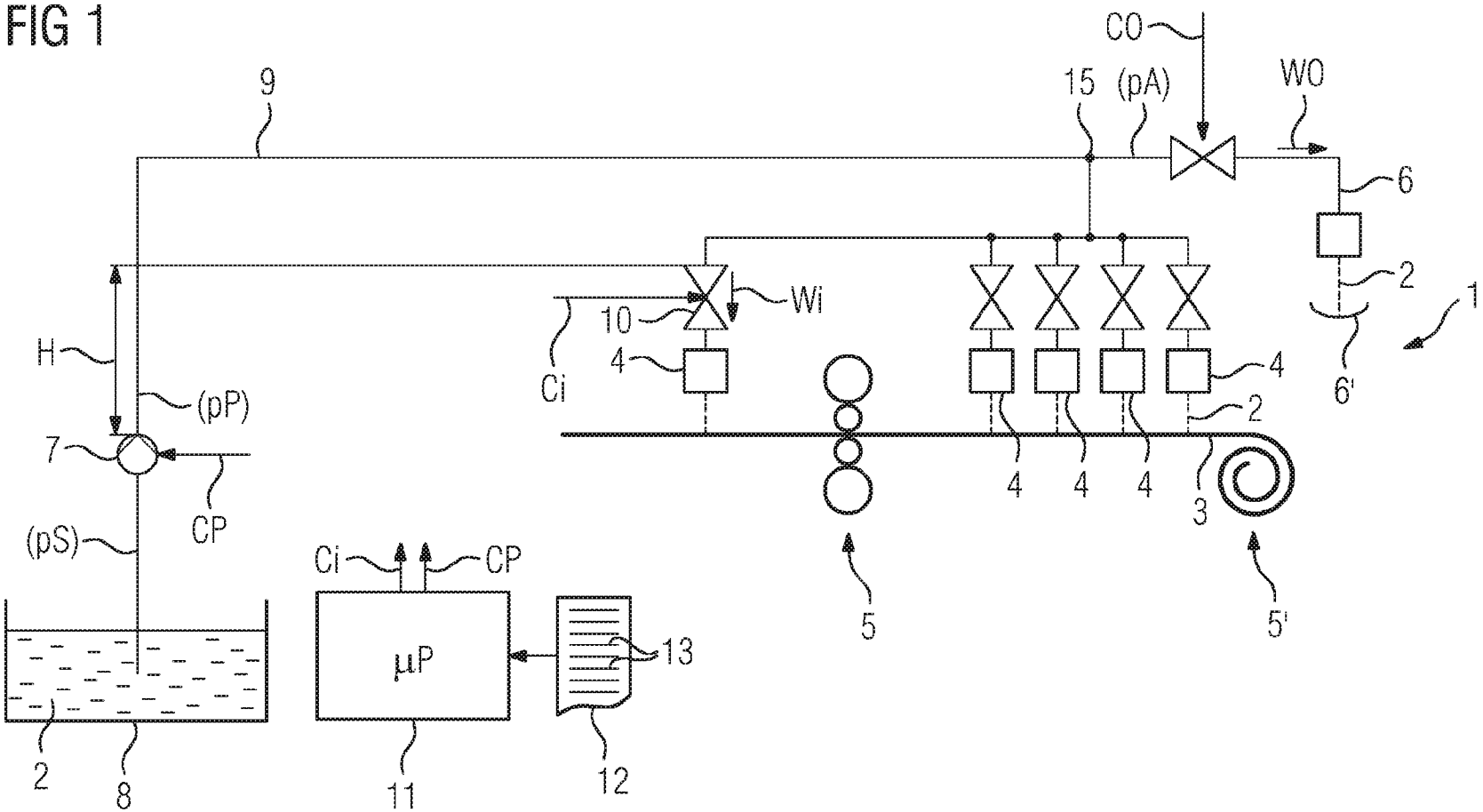
FIG. 1 shows a cooling path.

In accordance with FIG. 1 a cooling path has a cooling area 1. Within the cooling area 1 a liquid coolant 2—as a rule water—is applied to a hot rolled material 3 and the hot rolled material 3 is cooled thereby. The hot rolled material 3 consists of metal, for example of steel. To apply the liquid coolant 2 to the hot rolled material 3 a number of usable coolant outlets 4 are positioned in the cooling area 1. The cooling area 1 is positioned in accordance with the diagram shown in FIG. 1 partly within a rolling mill. This is indicated in FIG. 1 by one of the usable coolant outlets 4 being positioned upstream of a last rolling stand 5 of the rolling mill (for example a finishing train). The cooling area 1 could however likewise be positioned completely within the rolling mill. The cooling area 1 furthermore lies partly downstream of the rolling mill. This is indicated in FIG. 1 by the other usable coolant outlets 4 being positioned downstream of the last rolling stand 5 of the rolling mill. The cooling area 1 could however likewise be positioned completely downstream of the rolling mill. In the case of part or complete downstream arrangement the cooling area 1 can be positioned between the last rolling stand 5 and a coiler 5' for example. Furthermore it is also possible for the cooling area 1 to be positioned completely or partly upstream of the rolling mill. This is not shown in FIG. 1 and also not shown in the other figures.

In addition to the usable coolant outlets 4 there are preferably furthermore bypass coolant outlets 6 present. In FIG. 1 only a single such bypass coolant outlet 6 is shown. As a rule only a single bypass coolant outlet 6 is also present. In principle however a number of bypass coolant outlets 6 can be present. Regardless of the number of bypass coolant outlets 6 however, the hot rolled material 3 is cooled exclusively via the usable coolant outlets 4. Coolant 2, which is discharged via one of the bypass coolant outlets 6, does not serve to cool the hot rolled material 3. For example this part of the coolant 2 can be collected via a collection container 6' and returned. The return of the coolant 2 from the collection container 6' is not shown in FIG. 1 as well.

The cooling path has a pump 7. The pump 7 can extract coolant 2 from a coolant reservoir 8—for example a water tank—and feed it via a line system 9 to the coolant outlets 4, 6. The term "pump" is used in the generic sense within the framework of the present invention. Thus the pump 7 can involve a single pump or a number of pumps positioned one behind the other and/or in parallel.

Valves 10 are positioned between the pump 7 and the coolant outlets 4, 6. By means of the valves 10 coolant flows Wi, which are discharged via the coolant outlets 4, 6, can be controlled. The index i stands, when it has the value 0, for the bypass coolant outlet 6, the associated coolant flow W0 thus stands for the coolant flow discharged via the bypass coolant outlet 6. In a similar way the index i, when it has the value 1, 2, . . . n, stands in each case for one of the usable coolant outlets 4, the associated coolant flow Wi thus stands for the coolant flow discharged via the respective usable coolant outlet 4. The coolant flows Wi have the unit $m^3/s$.

The cooling path has a control device 11, which operates the cooling path in accordance with a method of operation that will be explained in greater detail below.

The control device 11 is embodied as a rule as a software-programmable control device. This is indicated in FIG. 1 by the control device 11 being labeled with the symbol "μP" for microprocessor. The control device 11 is programmed with a computer program 12. The computer program 12 comprises machine code 13, which is able to be processed by the control device 11. The programming of the control device 11 with the computer program 12 (or, its equivalent here, the processing of the machine code 13 by the control device 11) causes the control device 11 to operate the cooling path in accordance with the method of operation explained below.

As a result of its programming with the computer program 12 the control device 11 carries out the method of operation explained below in conjunction with FIG. 2:

In a step S1 the respective coolant flow Wi is made known to the control device 11 for a respective point in time for the usable coolant outlets 4. The respective coolant flow Wi is that coolant flow that is intended to be discharged at the respective point in time via the respective usable coolant outlet 4.

In a step S2 the control device 11 determines the coolant flow W0. The coolant flow W0 is that coolant flow that is intended to be discharged at the respective point in time via the respective bypass coolant outlet 6. As a rule the coolant flows W0 are determined as a function of the sum of the coolant flows Wi to be discharged via the usable coolant outlets 4. This will become evident from explanations given below.

In a step S3 the control device 11, by summing the coolant flows Wi, forms a total coolant flow WG valid for the respective point in time.

In individual cases it can occur that other consumers in addition to the usable coolant outlets 4 and the bypass coolant outlet 6 are connected to the line system 9. In this case the amount of coolant needed by the further consumers must be taken into consideration as well in the determination of the total coolant flow WG. Often the further consumers will also be controlled by the control device 11, so that this is readily possible. As an alternative it is possible to acquire an actual variable for example, on the basis of which the current consumption of the further consumer can be established. If supplementary information is not available, the amount of coolant needed by the further consumers can also be estimated.

In a step S4 the control device 11 establishes a change δWG in the total coolant flow WG. The change δW in the total coolant flow WG specifies the extent to which the total coolant flow WG changes at the respective point in time. Thus the derivation of the total coolant flow WG over time is involved. The control device 11, for establishing the change δW in the total coolant flow WG, can in particular use a total coolant flow WG' that is known to it from a previous cycle.

In a step S5 the control device 11 updates the total coolant flow WG' for the previous cycle. For example it accepts the value for the total coolant flow WG that it has established in step S3.

In a step S6 the control device 11 defines a working pressure pA (unit: N/m2). The working pressure pA is that pressure that the coolant 3 is to have at the inlet side of the valves 10. It is possible for the working pressure pA to be prespecified to the control device 11. As an alternative it is possible for the control device 11 to determine the working pressure pA by itself.

In a step S7 the control device 11 establishes activation states Ci (with i=0, 1, . . . n) for the valves 10. The activation states Ci can in particular be opening settings of the valves 10.

The valves 10 are preferably stepless or at least able to be activated in a number of steps. The coolant flow Wi flowing via the respective valve 10 can therefore be determined in accordance with relationship $$Wi=gi(Ci)\cdot\sqrt{pA/pA0} \tag{1}$$

Figure 3:
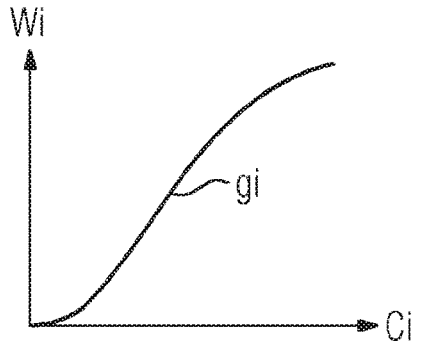
FIG. 3 shows a characteristic valve curve.

In equation 1 gi is a characteristic curve valid for the respective valve 10. The characteristic curve gi is a function of the respective activation state Ci. It specifies for a nominal pressure pA0 how great the coolant flow Wi flowing for a specific activation state Ci via the respective valve 10 is in each case. This is shown purely by way of example in FIG. 3 for a single valve 10. The characteristic curves gi of the valves 10 can either be taken from the datasheets of the manufacturer of the valves 10 or be established experimentally. To establish the activation state Ci required in each case the control device can solve equation 1 for Ci.

In a step S8 the control device 11 establishes a pump pressure pP. The pump pressure pP is that pressure that is intended to prevail at the outlet side of the pump 7, so that the working pressure pA is achieved at the inlet side of the valves 10. The control device 11 takes into consideration in the determination of the pump pressure pP at least the total coolant flow WG, the working pressure pA and the change δW in the total coolant flow WG. For example the control device 11 can establish the pump pressure pP in accordance with the relationship $$pP=pA+pH+p1(WG)+p2(\delta WG) \tag{2}$$

In equation 2 pH is an (as a rule constant) pressure that is caused by a height difference H. The height difference H is measured between the outlet side of the pump 7 and the outlets of the valves 10. The pressure p1 describes a drop in pressure that occurs as a result of the total coolant flow WG delivered on the way from the pump 7 to the valves 10. The pressure p1 thus describes the line resistance of the line system 9. The pressure p1 is an—as a rule non-linear—function of the total coolant flow WG. Also included in the pressure p1, where required, are additional resistances of the line system 9 such as for example filter resistances and more of the like. The pressure p2 is a function of the change δWG in the total coolant flow WG. It is calculated as follows:

For the acceleration of the coolant 3 in the line system 9 it is assumed below that the line system 9 has a uniform cross section A over its entire length L. If this is not the case, the following observation must be made for the individual sections of the line system 9, which each have a uniform cross section.

The amount of coolant 3 located in the line system 9 therefore amounts to AL, the mass m of the coolant 3 to ρAL, wherein ρ is the density of the coolant 3 (in the usual unit $kg/m^3$). The required acceleration a amounts to δWG/A. Thus the required force F amounts to ma, i.e. the product of mass m and acceleration a. Thus the required pressure p2 amounts to F/A. In an interrelationship the following therefore applies:

$$p2 = \frac{\rho \cdot L}{A} \cdot \delta WG \tag{3}$$

To take a numerical example: it is assumed that line system 9 has a length L of 100 m and a cross section A of 1 $m^2$. The coolant 3 is water. Within 1 second the total coolant flow WG is to be increased from 2 $m^3/s$ to 2.5 $m^3/s$. Then, for the required acceleration of the amount of water located in the line system 9, a pressure p2 of 50 kPa is required.

Figure 4:
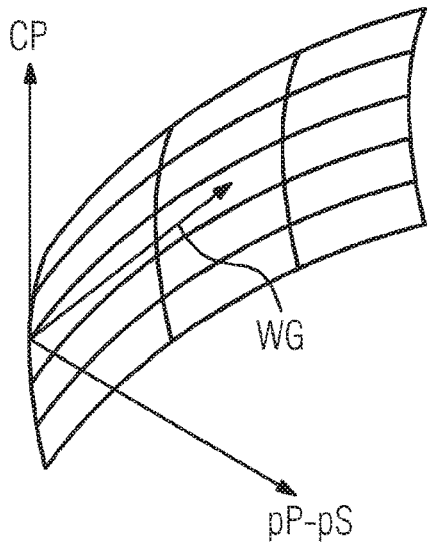
FIG. 4 shows a characteristic pump curve.

After the determination of the required pump pressure pP the control device 11 establishes, in a step S9, an associated activation state CP for the pump 7, so that at the outlet side of the pump 7 the desired pump pressure pP is achieved. The control device 11 takes into consideration in the determination the pump pressure pP, the total coolant flow WG and a suction pressure pS that prevails at the inlet side of the pump 7. The suction pressure pS can be prespecified to the control device 11 or acquired using measurement technology. It can, depending on the situation in the individual case, have a negative or a positive value or also the value 0. The control device 11 preferably uses a characteristic pump curve to establish the activation state CP for the pump 7. The characteristic pump curve relates the total coolant flow WG, the suction pressure pS at the inlet side of the pump 7 and the pump pressure pP at the outlet side of the pump 7 to one another. The characteristic pump curve can for example, as depicted in the diagram in FIG. 4, have the total coolant flow WG and the difference between pump pressure pP and suction pressure pS as its input parameter and deliver the associated activation state CP as its output parameter. The activation state CP can in particular be the rotational speed of the pump 7. Such characteristic curves are generally known to persons skilled in the art.

After the determination of all activation states Ci, CP the control device, in a step S10, activates the valves 10 and the pump 7 according to the activation states Ci, CP determined.

From step S10 the control device 11 returns to step S1. The control device 11 thus carries out the steps S1 to S10 cyclically, wherein the respective execution is valid for a respective point in time. Preferably there is a strictly cyclical execution, i.e. a fixed cycle time T exists, within which the steps S1 to S10 are each processed once. The cycle time T can lie between 0.1 seconds and 1.0 seconds for example, preferably between 0.2 seconds and 0.5 seconds, in particular at around 0.3 seconds.

In the simplest case only the usable coolant flows Wi (i=1, 2, . . . n) for the respective point in time and for points in time lying before the respective point in time are known to the control device 11. Even in this case the control device 11 can use the coolant flow W0 discharged via the bypass coolant outlet 6 to homogenize the activation state CP of the pump 7. For this purpose the control device 11 can employ a function F of form $$F=\alpha\cdot\|\Sigma_{i=1}^{n} Wi+W0-WG'\|+\beta W0-W0^*\| \tag{4}$$

WG' is the total coolant flow of the previous time. W0* is a nominal coolant flow prespecified for the bypass coolant outlet 6. Preferably it lies at around 30% to appr. 70% of the maximum coolant flow for the bypass coolant outlet 6, in particular at around 50% of this value. α and β are weighting factors. They are non-negative. Furthermore—without restricting the general applicability—it can be required that the sum of the two weighting factors α, β is 1. The double lines stand for a norm. The norm can in particular involve the usual square norm.

The coolant flows Wi for the usable coolant outlets 4 for the respective point in time are fixed values specified to the control device 11. The function F thus has as its sole freely selectable parameter the coolant flow W0 to be discharged via the bypass coolant outlet 6. It is therefore possible to establish the minimum of the function F and to employ as the coolant flow W0 for the bypass coolant outlet 6 that value at which this minimum is produced. A result achieved by this is that the coolant flow W0 to be discharged via the bypass coolant outlet 6 lies close to the nominal bypass coolant flow W0* and the change in the total coolant flow WG is as small as possible.

If no coolant outlet 6 is present, the establishment in accordance with equation 4 is not sensible. In this case the total coolant flow WG to be conveyed is produced from the sum of the usable coolant flows Wi. When the dynamic of the pump 7 is sufficient, a corresponding activation of the pump 7 is readily possible, so that the total coolant flow WG to be conveyed can be set. If however despite an activation of the pump 7 with a high dynamic an actually required change cannot be effected quickly enough, a temporary deviation of the actual total coolant flow conveyed by the pump 7 from a desired total coolant flow WG must be taken into account.

Figure 5:
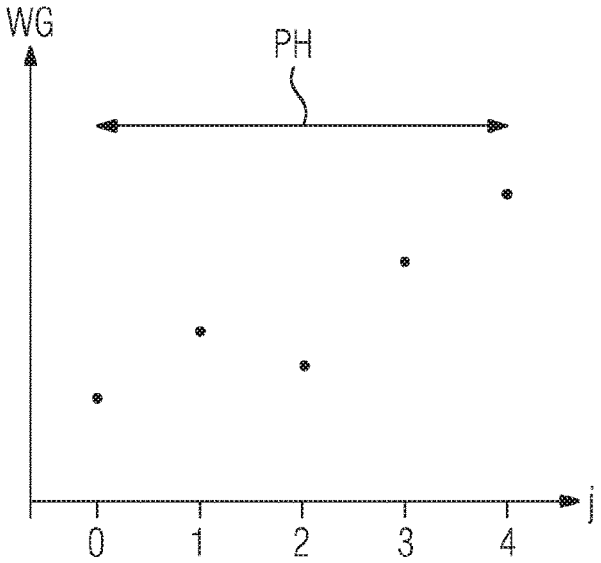
FIG. 5 shows a timing diagram.

Preferably however not only the coolant flows for the respective point in time and—related to the respective point in time—for the past are known to the control device 11, but additionally also usable coolant flows predicted for a prediction horizon PH, i.e. those coolant flows, which are intended to be discharged for a number of future points in time via the usable coolant outlets 4. This is shown in FIG. 5 for the total coolant flows WG produced in each case and a prediction horizon PH of (purely by way of example) four cycle times T. The term "prediction horizon" is furthermore not meant in the sense of how far a prediction is actually known to the control device 11. It is only a matter of the extent to which the control device 11 utilizes the prediction as part of the determination of the activation states Ci, CP for the valves 10 and the pump 7. The prediction horizon PH can lie in the range of 2 to 10 seconds for example. In general for a strictly cyclical execution of the procedure of FIG. 2 it should correspond to a number of cycle times T.

In the case of the predicted usable coolant flows also being known to the control device 11, the control device 11 can take into consideration the predicted usable coolant flows of at least one of the future points in time in the determination of the activation state CO for the valve 10 controlling the bypass coolant outlet 6 and/or the activation state CP of the pump 7. Various options for taking this into consideration exist here. A number of options will be explained below.

In order to illustrate the procedure, the coolant flows are provided with two indices below. The first index (i) stands—as before—for the respective coolant outlet 4, 6. The second Index (j) stands for the time, wherein a value of j=0 stands for the respective time, value of j=1 for the following time etc. In a similar way the total coolant flows are also provided with the second index (j). For example for the time labeled with the second index j=2, Wi2 are thus the respective coolant flows for the individual coolant outlets 4, 6, while WG2 designates the associated total coolant flow.

It is possible for example for the control device 11, for at least one future point in time, to establish the total coolant flow WGj (with j>0) to take this total coolant flow WGj into consideration in the determination of the change in the total coolant flow δWG. The corresponding total coolant flow WGj can in particular involve the total coolant flow WG1 for the next point in time.

For example the control device 11 for the respective time (j=0) and the next time (j=1) in each case as explained above, can optimize the function F and thereby establish for the two said points in time in each case the associated total coolant flow WG0, WG1 and then, on the basis of the relationship $$\delta WG = \frac{WG1 - WG0}{T} \tag{5}$$

establish the change in the total coolant flow δWG. Preferably however the control device 11, in the determination of the change δWG in the total coolant flow, takes into consideration in addition to the predicted usable coolant flows Wij of the at least one future point in time, furthermore also takes into consideration the total coolant flow WG' of at least one past time. The respective time should lie in the middle between the at least one future point in time and the at least one past point in time. In particular the control device 11 can establish the change δWG in the total coolant flow WG on the basis of the relationship $$\delta WG = \frac{WG1 - WG'}{2T} \tag{6}$$

As an alternative the total coolant flow WG' for the past point in time can involve a nominal value or an actual value. This is by contrast with the variable values usually used in the present case, in which nominal values are always involved.

The procedure just explained will be explained again in detail below in conjunction with FIG. 6.

Figure 2:
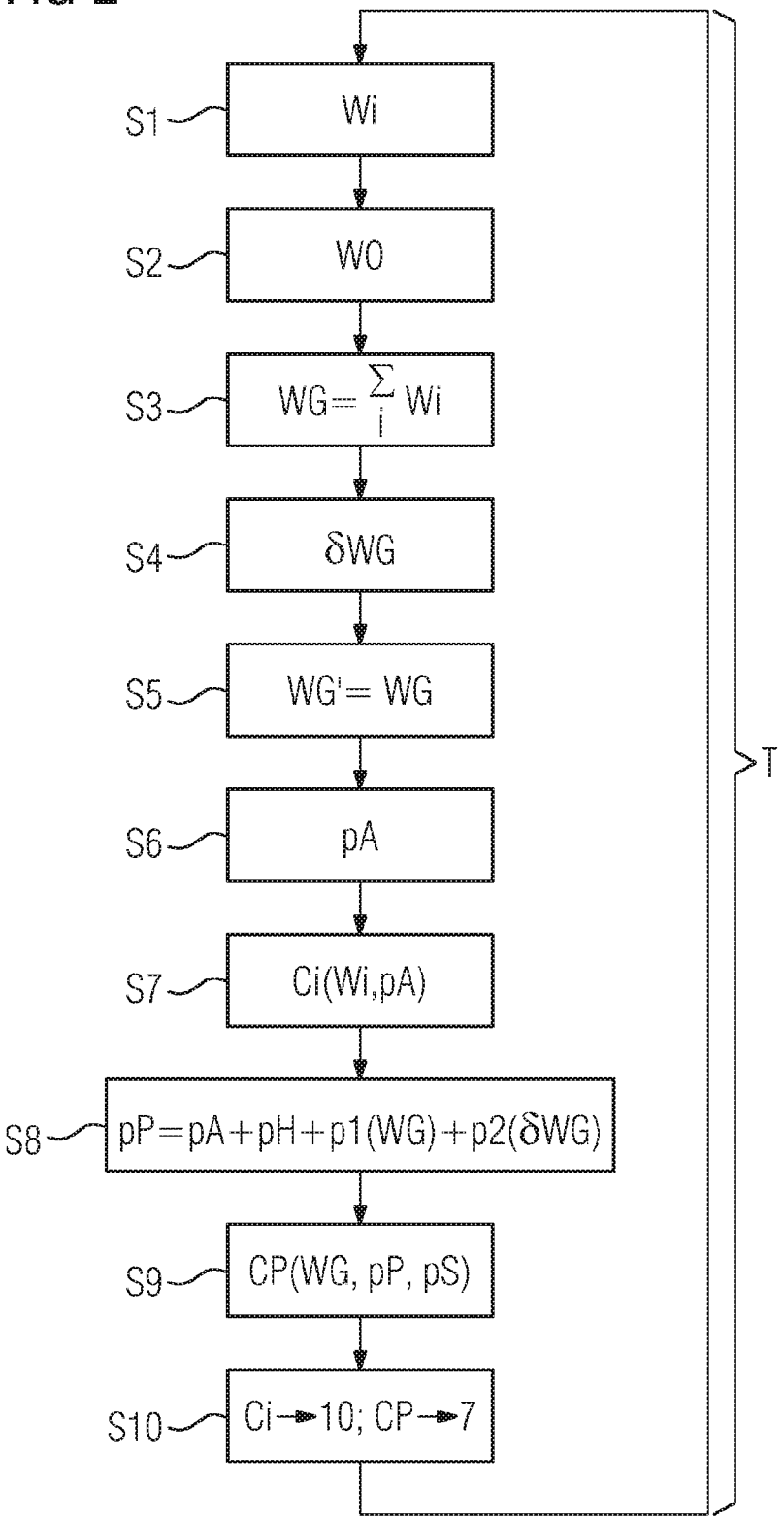
FIG. 2 shows a flow diagram.
Figure 6:
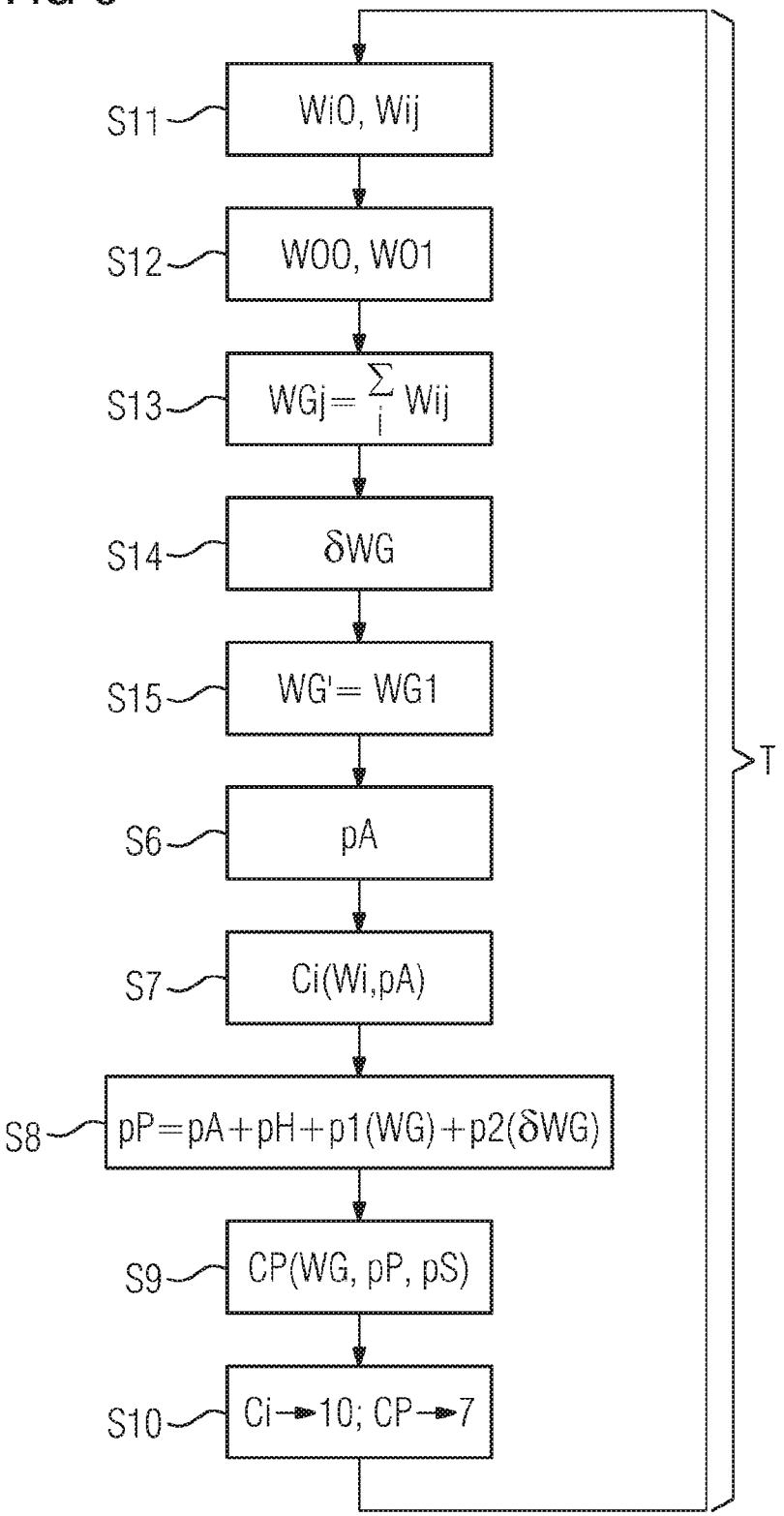
FIG. 6 shows a flow diagram.

FIG. 6 comprises inter alia—similarly to FIG. 2—the steps S6 to S10. These steps will therefore not be explained again below. The steps S1 to S5 are however replaced by steps S11 to S15.

In step S11 the respective coolant flow Wi0 is made known to the control device 11—similarly to step S1—for a respective point in time for the usable coolant outlets 4. To this extent the reader is referred to what has been said above regarding FIG. 2. In addition however the respective coolant flows Wij (with j=1, 2, . . . m) will be made known to the control device 11 for later points in time, i.e. for points in time that lie after the respective point in time, for the usable coolant outlets 4.

In step S12 the control device 11 determines the coolant flow W00. In particular the coolant flow W00 is produced on the basis of the relationship $$W00 = WG' - \Sigma_{i=1}^{n} Wi0 \tag{7}$$

What is achieved by this is that the prediction of the previous cycle will be adhered to as regards the change δWG in the total coolant flow WG0. What is thus achieved is that the total coolant flow WG0 of the current cycle matches the total coolant flow WG1 of the previous cycle. The total coolant flow predicted in the previous cycle is thus retained. This procedure is sufficient within the framework of FIG. 6, in which to establish the change δWG in the total coolant flow WG0 only the total coolant flow WG1 of the next cycle and the total coolant flow WG' of the previous cycle are taken into account. Similar procedures can if required also be used for further total coolant flows WGj (with j>1). In particular the procedure can be used for each total coolant flow WGj that has been taken into consideration in a previous cycle as part of the determination of the change δWG in the total coolant flow WG0 valid for the respective cycle. The coolant flows W0*j* are thus adapted for the bypass coolant outlet 6 in order to be able to keep the total coolant flow WGj that was utilized within the framework of the previous cycle, constant. Without bypass coolant outlet 6 changes that are produced for short periods might possibly no longer be taken into consideration.

Furthermore the control device 11, in step S12 for at least one cycle time T, for which the predicted usable coolant flows Wij are known to the control device 11, determines the associated bypass coolant flow W0*j*. Within the framework of the concrete procedure of FIG. 6 the control device 11 can for example establish the bypass coolant flow W01 by minimizing the following equation 8:

$$F = \alpha \| \Sigma_{i=1}^{n} W01 - WG0 \| + \beta \| W01 - W0^{*} \| \tag{8}$$

The procedure is the same as that which has already been explained in conjunction with equation 4.

In a step S13 the control device 11 forms the corresponding total coolant flows WGj by summing the corresponding coolant flows Wij.

In step S14 the control device 11 establishes the change δWG in the total coolant flow WG. The difference from step S4 of FIG. 2 lies in the fact that, in step S14, the control device 11 uses the above relationship specified in equation 6.

In step S15 the control device 11 updates the total coolant flow WG' for the previous cycle. The difference from step S5 of FIG. 2 lies in the fact that, in step S15, the control device 11 does not use the total coolant flow WG0 of the current cycle but the total coolant flow WG1, which it has utilized within the framework of the determination of the change δWG in the total coolant flow WG0.

A further option for taking into account the predicted usable coolant flows will be explained below in conjunction with FIG. 7.

As already explained above, the control device 11—see step S13 in FIG. 6—for the respective point in time and for points in time lying after this point in time, establishes the associated total coolant flow WGj. FIG. 7 shows this for a prediction horizon PH of four cycle times T. This prediction horizon PH is of course only by way of example however.

The prediction horizon PH could also be larger or smaller. The total coolant flows WGj established are shown in FIG. 7 by small crosses.

Figure 7:
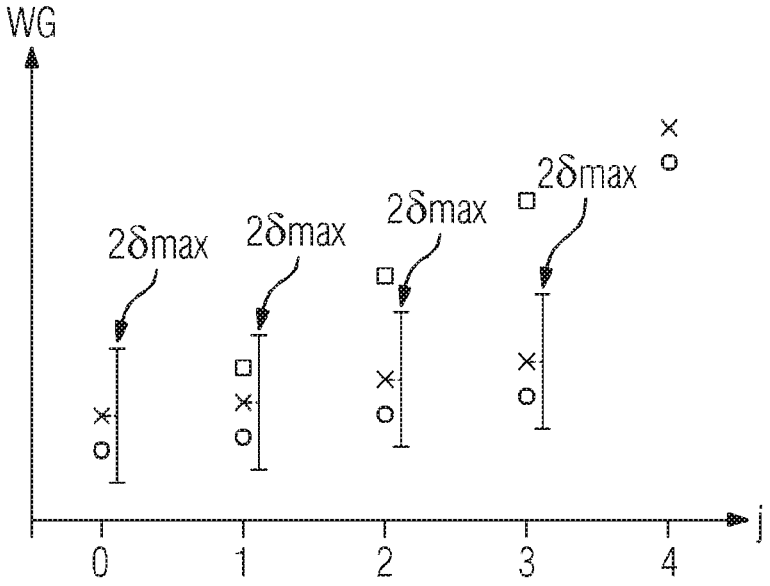
FIG. 7 shows a timing diagram.

FIG. 7 furthermore shows the respective sum of the usable coolant flows Wij. This can readily be established as part of the prediction horizon PH, since the usable coolant flows Wij are known to the control device 11. The associated sums of the usable coolant flows Wij are indicated in FIG. 7 by small circles.

The control device 11 furthermore, by forming the difference between directly consecutive total coolant flows WGj—for example the total coolant flows WG1 and WG2—now establishes the associated changes in the total coolant flows WGj. Then the control device 11 checks within the prediction horizon PH whether the established changes in the total coolant flows WGj each keep to a predetermined maximum change δmax or not. When the total coolant flows WGj keep to the maximum change δmax, the control device 11 retains the established total coolant flows WGj. When on the other hand the total coolant flows WGj do not keep to the maximum change δmax, the control device 11 adapts established total coolant flows WGj predictively. The associated modified total coolant flows WGj are shown in FIG. 7 by small rectangles.

The adaptation is undertaken where possible in such a way that both the change δWG in the total coolant flow WG0 for the respective point in time and also the changes in the established total coolant flows WGj for the future points in time keep to the maximum change δmax. This situation is shown in FIG. 7.

If possible the control device 11, within the framework of the adaptation, retains the predetermined usable coolant flows Wij for the various points in time and just adapts the bypass coolant flows W0*j*. If keeping to the maximum change max cannot be achieved exclusively with an adaptation of the bypass coolant flows W0*j*, an adaptation of the usable coolant flows Wij must also be undertaken however. Without bypass coolant outlet 6 required adaptations have to be undertaken completely through an adaptation of the usable coolant flows Wij.

Thus, based on the forecast, an advance predictive planning can be undertaken. This can be required not only, as shown in FIG. 7, for an increase in the required total coolant flows WGj, but also for a reduction in the required total coolant flows WGj.

Within the framework of the procedure in accordance with FIG. 2—the same applies to the procedure according to FIG. 6—the working pressure pA is fixed once in step S6 and is not changed again thereafter. It is however possible to modify the procedure of FIG. 2, as will be explained below in conjunction with FIG. 8. A similar modification is possible for the procedure of FIG. 6.

Figure 8:
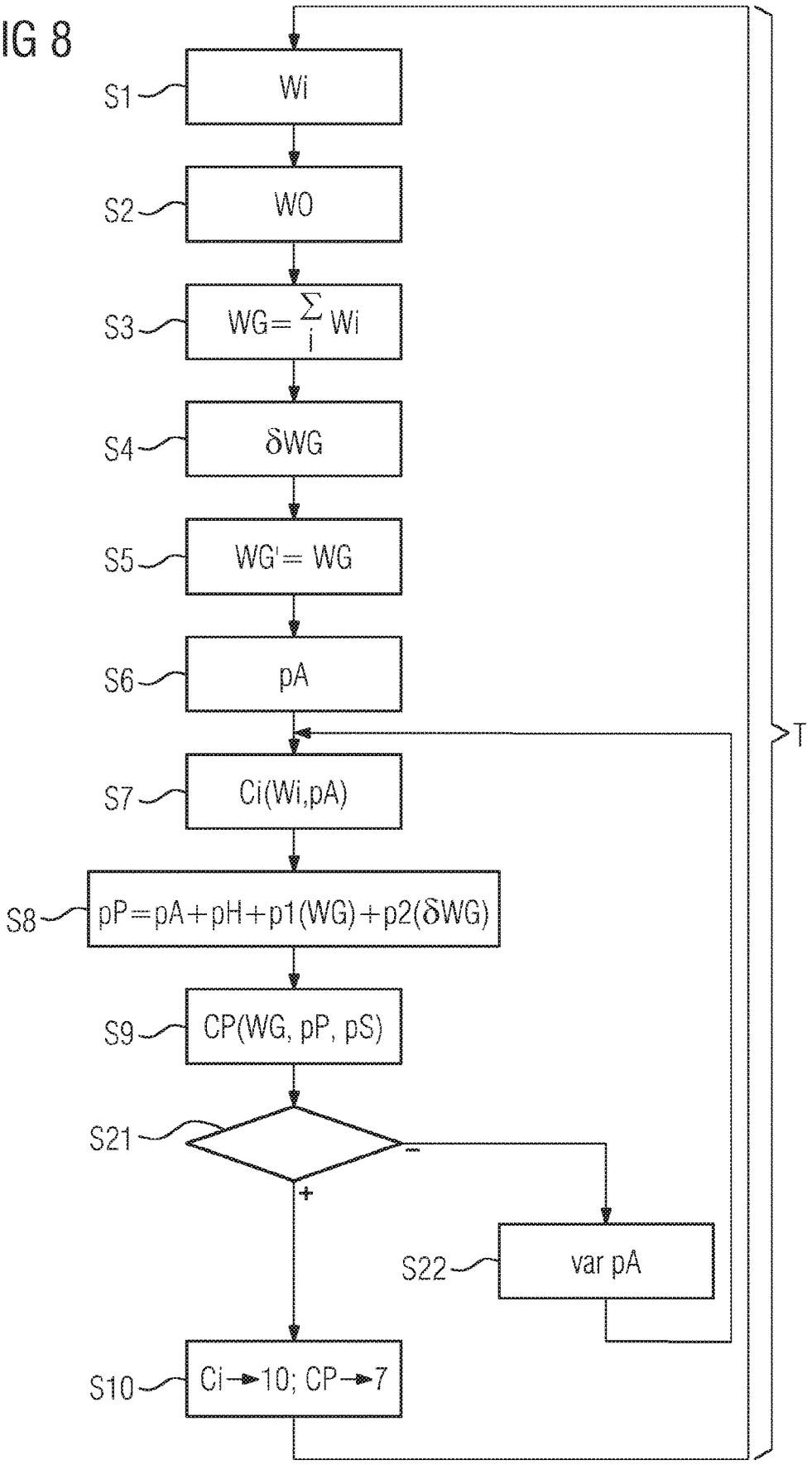
FIG. 8 shows a flow diagram.

In accordance with FIG. 8 a step S21 is present between the steps S9 and S10. In step S21 the control device 11 checks whether the activation states Ci of the valves 10 are keeping to minimum distances for a minimum activation of the respective valve 10 and a maximum activation of the respective valve 10. The control device 11 furthermore checks in step S21 the extent to which the activation state CP of the pump 7 has been changed. For example the control device 11, within the framework of step S21, can use an optimization problem with boundary conditions to be observed. Such optimization problems are generally known to persons skilled in the art.

When the control device 11, in step S21, comes to the conclusion that the activation states Ci of the valves 10 are keeping to the minimum distances and the activation state CP of the pump 7 is being kept constant as far as possible, the control device 11 goes to step S10. Otherwise the control device 11 goes to a step S22. In step S22 the control device 11 varies the working pressure pA used in the sense of the said optimization.

Figure 9:
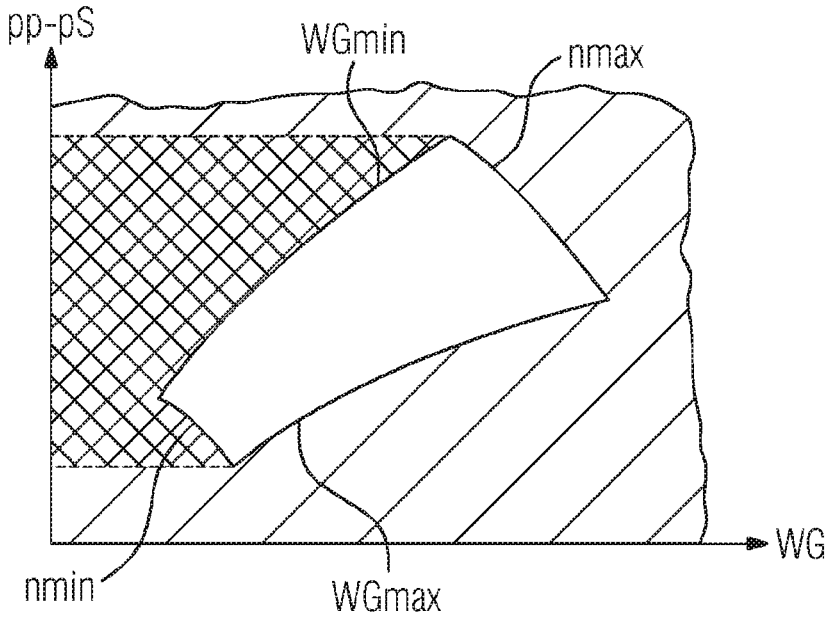
FIG. 9 shows a pump diagram.

The pump 7 has a permissible operating range. In particular the operation of the pump 7, in accordance with the diagram in FIG. 9, is only permitted between a minimum rotational speed nmin and a maximum rotational speed nmax. Furthermore the amount of coolant conveyed—i.e. the respective total coolant flow WG—must lie between a minimum permitted coolant flow WGmin and a maximum permitted coolant flow WGmax. The minimum permitted coolant flow WGmin and the maximum permitted coolant flow WGmax are dependent here, in accordance with the diagram in FIG. 9, on the difference between the pump pressure pP and the suction pressure pS. Without further measures the pump 7 can therefore only be operated within the non-hatched area in FIG. 9.

Figure 10:
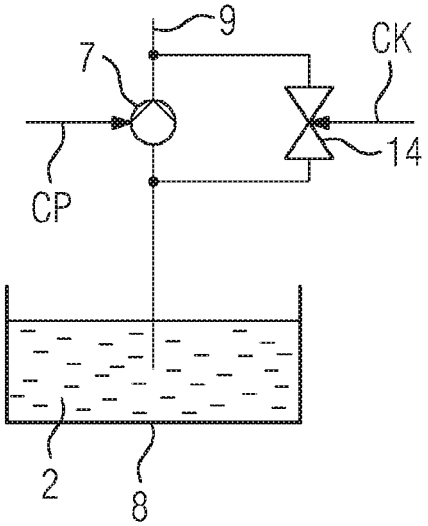
FIG. 10 shows a pump with a bypass valve connected in parallel.

It is however possible to connect the pump 7 according to the diagram in FIG. 10 in parallel with a bypass valve 14. Through this—depending on the activation of the bypass valve 14—it is possible to divert between 0% and 100% of the coolant flow conveyed by the pump 7 via the bypass valve 14 and feed it back to the input side of the pump 7 or to the coolant reservoir 8. Through this only the remaining, non fed-back portion remains as the total coolant flow WG. Thus it is not only possible to operate the total system of pump 7 and bypass valve 14 within the non-hatched area in FIG. 9. This would also be possible without the bypass valve 14. Instead it is additionally also possible because of the bypass valve 14 to operate the total system of pump 7 and bypass valve 14 within the crosshatched area in FIG. 9. A control signal CK for the bypass valve 14 can be established for example within the framework of step S9 (cf. FIG. 2 and FIG. 6). Naturally in this case there is a corresponding activation in S10 of the bypass valve 14 by the control device 11.

Preferably, in the case of the embodiment in accordance with FIG. 10 there is first a check as to whether the pump 7 can be operated in a range permitted per se. If this is the case, the bypass valve 14 remains (completely) closed. If this is not the case, the bypass valve 14 is opened as far as is required in order to operate the pump 7 in a range permitted per se.

The present invention has been explained above for a simple embodiment of the line system 9, namely in accordance with the diagram in FIG. 1 for a single direct connection from the pump 7 to the valves 10, wherein the lengths of the individual branch lines between a node point 15 at which the branch lines branch off to the individual valves 10 and the coolant outlets 4, 6 can be ignored. The present invention is also applicable however when the line system 9 is a more complex design. In this case it merely has to be taken into consideration that for each node point at which a branch occurs, the sum of the coolant flows flowing into the respective node point and coolant flows flowing out of the respective node point must amount to 0 overall and that there must be the same pressure at the respective node point for each connected section of the line system 9. The procedure is similar to Kirchhoff s rules of electrical engineering. Although this makes the procedure more complicated in processing terms, the systems remain unchanged for example.

The systems even remain unchanged when separate pumps are positioned in individual sections of the sections of the line system 9. This is explained below in greater detail in conjunction with FIG. 11 with reference to an example.

Figure 11:
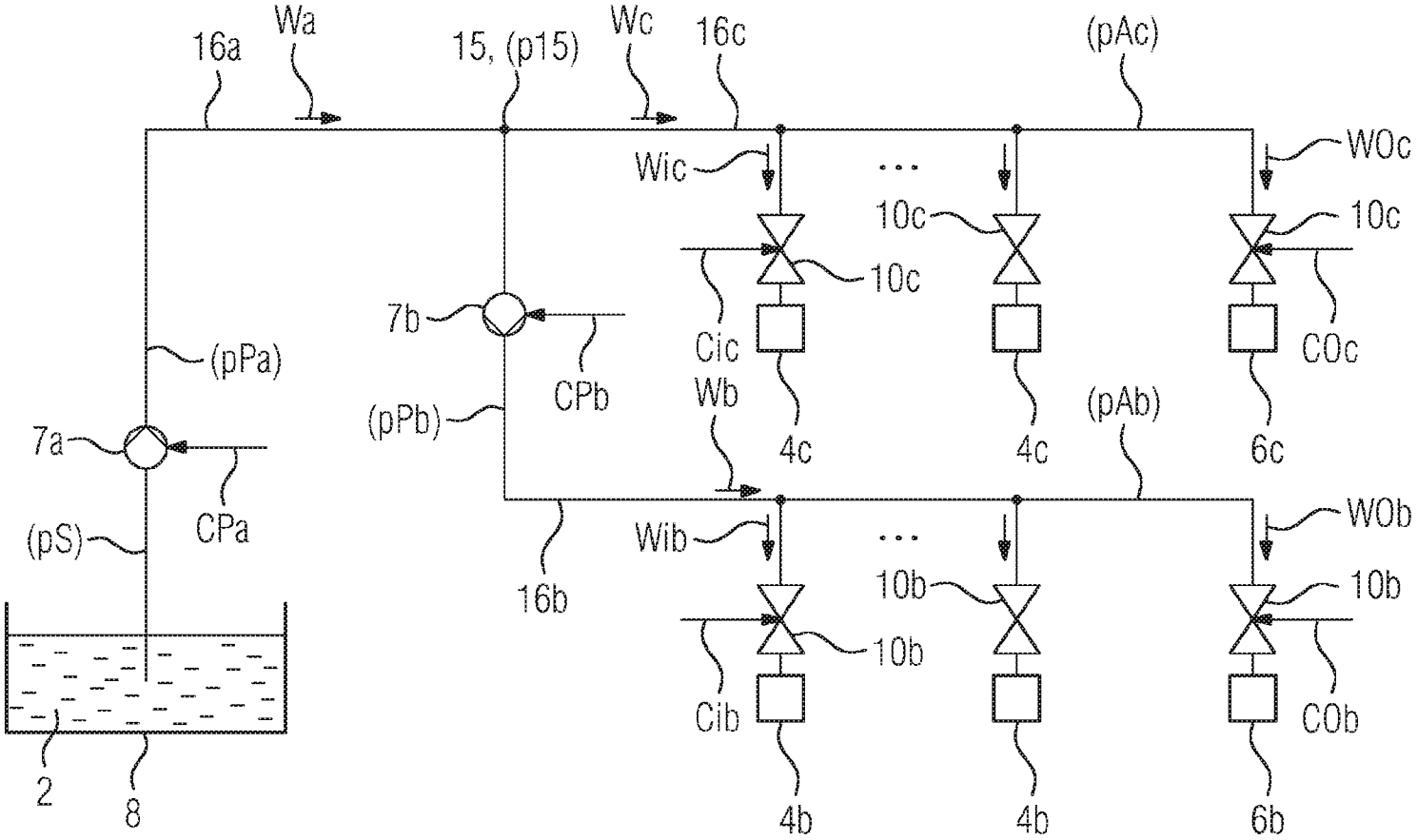
FIG. 11 shows a cooling path.

In accordance with FIG. 11 the line system 9 has three sections 16*a*, 16*b*, 16*c*. Section 16*a* extends from a pump 7*a* to a node point 15. It has the length La and the cross section Aa. From the node point 15 the two other sections 16*b*, 16*c* extend to respective usable coolant outlets 4*b*, 4*c* and respective bypass coolant outlets 6*b*, 6*c*. In section 16*b* a further pump 7*b* is located shortly after the node point 15. The section 16*b* has a length Lb and a cross section Ab. No pump is located in section 16*c*. The section 16*c* has a length Lc and a cross section Ac. Valves 10*b*, 10*c* are positioned in each case upstream of the coolant outlets 4*b*, 4*c* and 6*b*, 6*c*. The configuration shown in FIG. 11 can occur for example in a cooling path which on the one hand has an intensive cooling (coolant outlets 4*b*) and additionally a laminar cooling (coolant outlets 4*c*) as well as a bypass coolant outlet 6*b*, 6*c* for each of the two coolings. The hot rolled material 3 and the arrangement of the usable coolant outlets 4*b*, 4*c* in cooling area 1 are not shown as well in FIG. 11 in order not to overload FIG. 11.

The activation states Cic of valves 10*c* in section 16*c* are produced in accordance with $$Wic=gic(Cic)\cdot\sqrt{pAc/pA0} \tag{9}$$

Wic are the respective coolant flows, gic is the respective characteristic valve curve, pAc the working pressure prevailing at the inlet side of the valves 10*c*. pA0, as already explained in conjunction with equation 1, is a nominal pressure pA0. Through this the total coolant flow We for the section 16*c* is produced as $$Wc=\Sigma Wic \tag{10}$$

From this, ignoring height differences to be overcome, the pressure p15 at node point 15 is as follows:

$$p15=pAc+p1c(Wc)+p2c(\delta Wc) \tag{11}$$

p1*c* and p2*c* are defined similarly to the functions p1 and p2, but in relation to section 16*c*. δWc is the change in the total coolant flow Wc.

In a similar manner the activation states Cib of the valves 10*b* in section 16*b* are produced according to $$Wib=gib(Cib)\cdot\sqrt{pAb/pA0} \tag{12}$$

Wib are the respective coolant flows, gib is the respective characteristic valve curve, pAb the working pressure prevailing at the inlet side of the valves 10*b*. pA0 as before is a nominal pressure pA0. Through this the total coolant flow Wb for section 16*b* is produced as $$Wb=\Sigma Wib \tag{13}$$

From this—once again ignoring height differences to be overcome—the following is produced for the pump pressure pPb at the outlet side of pump 7*b:*

$$pPb=pAb+p1b(Wb)+p2b(\delta Wb) \tag{14}$$

p1*b* and p2*b* are defined similarly to the functions p1 and p2, but in relation to section 16*b*. δWb is the change in the total coolant flow Wb. Through this, also according to $$CPb=CPb(Wb,pPb-p15) \tag{15}$$

the required activation state CPb of the pump 7*b* can be established.

The total coolant flow Wa flowing in section 16*a* is produced as the sum of the total coolant flows Wb, Wc flowing in sections 16*b* and 16*c:*

$$Wa=Wb+Wc \tag{16}$$

Through this, on the basis of the relationship $$pPa=p16+p1a(Wa)+p2a(\delta Wa) \tag{17}$$

the required pump pressure pPa at the outlet side of the pump 7*a* can now be established. p1*a* and p2*a* are defined similarly to the functions p1 and p2, but related to section 16*a* however. On the basis the pump pressure pPa, by means of the relationship $$CPa=CPa(Wa,pPa—pS) \tag{18}$$

the activation state CPa of the pump 7*a* can now be established.

The working pressures pAb and pAc are now target values of the system that are predetermined or under some circumstances can be determined by the control device 11. The total coolant flows Wb, We are known. For establishing the changes δWb, δWc (and thus as a result also the change δWa) the reader can refer to what has been said in conjunction with FIGS. 2 and 6. The equation system is thus uniquely solvable.

Here too however a realization without bypass coolant outlets 6*b*, 6*c* is possible.

The present invention has many advantages. In particular the coolant flows Wi, WG conveyed are made available with high precision, without needing a water tank or other compensation measures. The working pressure pA can be chosen as required and even adapted during the operation of the cooling path. The operating range of the cooling path is expanded. In particular if required both the suction pressure pS and also the pump pressure pP can be varied. This applies both to a pure laminar cooling and also to a pure intensive cooling and also to a cooling path that comprises both a laminar cooling and also an intensive cooling. As a result of the adaptation of the working pressure pA and of the pump pressure pP, energy can be saved to a considerable extent. In a wide hot strip mill this enables the average energy consumption that is required for pumping the coolant 2 to be reduced by at least 30% compared to the solutions in the prior art, in many cases even by up to 50%. The cost savings associated herewith can lie in the range of far beyond €100,000 per year. Furthermore the method is extremely flexible. Within a few seconds the total coolant flow WG can be increased from a minimum value to a maximum value or conversely reduced from the maximum value to the minimum value without the accuracy of the cooling suffering.

Although the invention has been illustrated and described in greater detail by the preferred exemplary embodiment, the invention is not restricted by the disclosed examples and other variants can be derived herefrom by the person skilled in the art, without departing from the scope of protection of the invention.

LIST OF REFERENCE CHARACTERS

1 Cooling area
2 Coolant
3 Rolled material
4, 4*b*, 4*c* Usable coolant outlets
5 Rolling stand
5' Coiler
6, 6*b*, 6*c* Bypass coolant outlet
6' Collection container
7, 7*a*, 7*b* Pumps
8 Coolant reservoir
9 Line system
10, 10*b*, 10*c* Valves
11 Control device

12 Computer program
13 Machine code
14 Bypass valve
15 Node point
16*a*, 16*b*, 16*c* Sections of the line system
A, Aa, Ab, Ac Cross section of the line system
Ci, Cib, Cic Activation states of the valves
CP, CPa, CPb Activation states of pumps
F Function
gi, gib, gic Characteristic valve curves
H Height difference
i,j Indices
L, La, Lb, Lc Length of the line system
nmin, nmax Rotational speeds
p1, p1*a* to p1*c* Functions
p2, p2*a* to p2*c*
p15 Pressure
pA, pAb, pAc Working pressures
pA0 Nominal pressure
PH Prediction horizon
pP, pPa, pPb Pump pressures
pS Suction pressure
S1 to S22 Steps
T Working time
WG, WG', WGj Total coolant flows
Wgmin, Wgmax Coolant flows
Wi, W0, Wij
W0* Nominal coolant flow
α, β Weighting factors
δWG, δWa, δWb, δWc Change in the total coolant flow
δmax Maximum change
ρDensity of the coolant

The invention claimed is:

1. A method of operation for a cooling path for cooling hot rolled material composed of metal, comprising:

extracting coolant from a coolant reservoir by a pump in the cooling path;

feeding the coolant via a line system to a plurality of coolant outlets, the plurality of coolant outlets being controlled by a plurality of valves positioned upstream of the plurality of coolant outlets; and activating the plurality of valves and the pump according to activation state (Ci) for the plurality of valves and activation state (CP) for the pump, the activation state (Ci) and the activation state (CP) being determined by a control device of the cooling path, the control device performing cyclically the following operations:

establishing the activation state (Ci) based on coolant flows (Wi), which are intended to be discharged at a point in time via the plurality of coolant outlets, in conjunction with a working pressure (pA) of the coolant prevailing at an inlet side of the plurality of valves;

establishing a total coolant flow (WG) by summing the coolant flows (Wi);

establishing a pump pressure (pP) that is intended to prevail at the outlet side of the pump, so that the working pressure (pA) is achieved at the inlet side of the plurality of valves, based on the total coolant flow (WG), the working pressure (pA) of the coolant, and a change (δWG) in the total coolant flow (WG); and establishing the activation state (CP) based on the total coolant flow (WG) the pump pressure (pP), and a suction pressure (pS) prevailing at an inlet side of the pump.

2. The method of operation as claimed in claim 1, wherein the establishing of the pump pressure (pP) by the control device is based on a line resistance (p2) of the line system to be overcome by the total coolant flow (WG).

3. The method of operation as claimed in claim 1, wherein, in addition to discharge coolant flows (Wij), which are to be discharged at the point in time via the coolant outlets, discharge coolant flows (Wij), which are discharged for a number of future points in time via the coolant outlets for a prediction horizon (PH) are known to the control device, and that the control device takes into consideration predicted coolant flows (Wij) of at least one of the future points in time in the determination of the activation state (CP) of the pump.

4. The method of operation as claimed in claim 3, wherein the control device establishes an associated total coolant flow (WGj) for at least one future point in time and takes it into consideration in the determination of the change (δWG) in the total coolant flow (WG0).

5. The method of operation as claimed in claim 4, wherein the control device, in the determination of the change (δWG) in the total coolant flow (WG0), in addition to the predicted coolant flows (Wij) of the at least one future point in time, furthermore also takes into consideration the total coolant flow (WG') of at least one past point in time and that the point in time lies in the middle between the at least one future point in time and the at least one past point in time.

6. The method of operation as claimed in claim 4, wherein:

the coolant outlets comprise usable coolant outlets and bypass coolant outlets;

the hot rolled material is cooled exclusively by means of the coolant flows (Wij) discharged via the usable coolant outlets; and the control device, on the basis of the coolant flows (Wij) to be discharged for at least one of the point in time and the future points in time via the usable coolant outlets, determines the coolant flows (Wi0) to be discharged for the point in time and—the future points in time via the bypass coolant outlets, the determination being performed so that each total coolant flow (WGj) that takes into consideration a valid change (δWG) in the total coolant flow (WG) at an earlier point in time lying before the respective point in time.

7. The method of operation as claimed in claim 3, wherein the control device, in the determination of the activation state (CP) of the pump:

for the future points in time, establishes on the basis of the predicted coolant flows (Wij) an associated total coolant flow (WGj);

for the future points in time, establishes changes of the established total coolant flows (WGj); and for at least one of the point in time and the future points in time within the prediction horizon (PH), retains or predictively adapts the associated total coolant flows (WGj) as a function of keeping to or exceeding a predetermined maximum change (δmax), so that where possible both the change in the total coolant flow (WG0) for the point in time and also the changes in the associated total coolant flows (WGj) for the future points in time keep to the maximum change (δmax).

8. The method of operation as claimed in claim 1, wherein:

the coolant outlets comprise usable coolant outlets and bypass coolant outlets;

the hot rolled material is cooled exclusively by means of the coolant flows (Wi) discharged via the usable coolant outlets; and the control device determines the coolant flows (W0) to be discharged via the bypass coolant outlets in such a way that the coolant flows (W0) to be discharged via the bypass coolant outlets lie as close as possible to a nominal bypass coolant flow (W0*) and a change (δWG) in the total coolant flow (WG) to be discharged overall via the usable coolant outlets and the bypass coolant outlets is as small as possible.

9. The method of operation as claimed in claim 1, wherein the valves are able to be activated steplessly or at least in a number of steps.

10. The method of operation as claimed in claim 1, wherein the control device determines the working pressure (pA) in such a way that the activation states (Ci) of the valves keep to minimum distances for a minimum activation and a maximum activation and the activation state (CP) of the pump is kept constant as far as possible.

11. The method of operation as claimed in claim 1, wherein the control device, within the framework of the determination of the pump pressure (pP), additionally also takes into consideration a height difference (H) to be overcome.

12. The method of operation as claimed in claim 1, wherein the control device additionally establishes a control signal (CK) for a bypass valve connected in parallel with the pump and activates the bypass valve according to the control signal (CK) established.

13. A computer program, which comprises machine code that is able to be executed by a control device for a cooling path, wherein the processing of the machine code by the control device causes the control device to operate the cooling path in accordance with a method of operation as claimed in claim 1.

14. A control device for a cooling path, wherein the control device is programmed with a computer program as claimed in claim 13.

* * * * *